US006175352B1

(12) United States Patent
Kay et al.

(10) Patent No.: US 6,175,352 B1
(45) Date of Patent: Jan. 16, 2001

(54) ADDRESS GENERATOR DISPLAY AND SPATIAL LIGHT MODULATOR

(75) Inventors: Andrew Kay, Oxford; Michael Geraint Robinson; Craig Tombling, both of Stadhampton, all of (GB)

(73) Assignee: Sharp Kabushiki Kaisha, Osaka (JP)

( * ) Notice: Under 35 U.S.C. 154(b), the term of this patent shall be extended for 0 days.

(21) Appl. No.: 08/883,508

(22) Filed: Jun. 26, 1997

(30) Foreign Application Priority Data

Jun. 27, 1996 (GB) ..... 9613566

(51) Int. Cl.[7] ..... G09G 3/36
(52) U.S. Cl. ..... 345/100; 345/99; 345/103
(58) Field of Search ..... 345/132, 87, 98, 345/99, 100, 103

(56) References Cited

U.S. PATENT DOCUMENTS

| | | | | |
|---|---|---|---|---|
| 4,348,186 | | 9/1982 | Harvey et al. | 434/44 |
| 4,634,384 | | 1/1987 | Neves et al. | 434/44 |
| 4,677,594 | | 6/1987 | Bisotto et al. | 365/240 |
| 5,132,678 | | 7/1992 | Morris | 340/800 |
| 5,204,661 | | 4/1993 | Hack et al. | 340/784 |
| 5,206,634 | | 4/1993 | Matsumoto et al. | 340/784 |
| 5,266,936 | | 11/1993 | Saitoh | 345/98 |
| 5,339,090 | * | 8/1994 | Crossland et al. | 345/90 |
| 5,363,424 | | 11/1994 | Fujisawa | 377/69 |
| 5,442,372 | * | 8/1995 | Shiki | 345/100 |
| 5,859,627 | * | 1/1999 | Hoshiya et al. | 345/100 |

FOREIGN PATENT DOCUMENTS

| | | |
|---|---|---|
| 0145143 | 6/1985 | (EP) . |
| 0151077 | 8/1985 | (EP) . |
| 0565167 | 10/1993 | (EP) . |
| 0632646 | 1/1995 | (EP) . |
| 0678847 | 10/1995 | (EP) . |
| 2050032 | 12/1980 | (GB) . |
| 2259213 | 3/1993 | (GB) . |
| 06075204 | 3/1994 | (JP) . |

OTHER PUBLICATIONS

Search Report for Application No. 97304638.6; Dated Sep. 23, 1998 (EPO).

Search Report for Application No. 97304638.6–; Dated Nov. 27, 1997 (EPO Application).

B.J. Lechner et al.; Proc. IEEE, vol. 59, No. 11, pp. 1566–1579, 1971, "Liquid Crystal Matrix Displays".

A.G. Lewis et al.; Conference Record of the 1994 SID International Display Research Conference, pp. 56–64, 1994, "Driver Circuits for AMLCDs".

* cited by examiner

*Primary Examiner*—Dennis-Doon Chow
(74) *Attorney, Agent, or Firm*—Renner, Otto, Boisselle & Sklar LLP

(57) ABSTRACT

An address generator for a display or spatial light modulator, comprising a first shift register having a plurality of cascade-connected stages for controlling respective first address electrodes of the display or spatial light modulator. The stages of the first shift register include a first reconfigurable shift register stage which is selectively operable in an alternate mode, in which the output of the first reconfigurable shift register stage follows the output of a preceding stage.

23 Claims, 7 Drawing Sheets

ADDRESS GENERATOR DISPLAY AND SPATIAL LIGHT MODULATOR

TECHNICAL FIELD OF THE INVENTION

The present invention relates to an address generator for a display or spatial light modulator. The invention also relates to a display and to a spatial light modulator.

BACKGROUND OF THE INVENTION (Not Applicable)

SUMMARY OF THE INVENTION

According to a first aspect of the invention, there is provided an address generator for a display or spatial light modulator, comprising a first shift register having a plurality of cascade-connected stages for controlling respective first address electrodes of the display or spatial light modulator, characterised in that the stages of the first shift register include a first reconfigurable shift register stage which is selectively operable in an alternate mode, in which the output of the first reconfigurable shift register stage follows the output of a preceding stage.

The first shift register may be an analogue shift register. As an alternative, the first shift register may be a digital shift register.

Each stage of the first shift register may comprise a first memory having a first memory.enable input connected to a first phase of a first bi-phase clock line and a second memory having a second memory enable input connected to a second phase of the first bi-phase clock line, the first memory enable input of the first reconfigurable shift register stage of the first shift register being selectively connectable to the second phase of the first bi-phase clock line. Each of the first and second memories may comprise a bistable circuit. Each of the stages subsequent to a first stage of the first shift register may comprise a switch for selectively connecting the first memory enable input to the first or second phase of the first bi-phase clock line. The generator may comprise a first further shift register having a plurality of cascade-connected stages for controlling respective ones of the switches of the first shift register.

The first shift register may comprise a first sub-shift register having a first plurality of cascade-connected sub-stages and a second sub-shift register having a second plurality of cascade-connected sub-stages, the first plurality of sub-stages being interlaced with the second plurality of sub-stages.

The generator may comprise a second shift register having a plurality of cascade-connected stages for controlling respective second address electrodes of the display or spatial light modulator, the stages of the second shift register including a second reconfigurable shift register stage which is selectively operable in the alternate mode.

The second shift register may be an analogue shift register. As an alternative, the second shift register may be a digital shift register, Each stage of the second shift register may comprise a third memory having a third memory enable input connected to a first phase of a second bi-phase clock line and a fourth memory having a fourth memory enable input connected to a second phase of the second bi-phase clock line, the third memory enable input of the second reconfigurable shift register stage of the second shift register being selectively connectable to the second phase of the second bi-phase clock line. Each of the third and fourth memories may comprise a bi-stable circuit. Each of the stages of the second shift register subsequent to a first stage thereof may comprise a switch for selectively connecting the third memory enable input to the first or second phase of the second bi-phase clock line. The generator may comprise a second further shift register having a plurality of cascade-connected stages for controlling respective ones of the switches of the second shift register.

According to a second aspect of the invention, there is provided a spatial light modulator including an address generator in accordance with the first aspect of the invention.

The spatial light modulator may be of the matrix type, for instance of the active matrix type, and may be of liquid crystal type.

According to a third aspect of the invention, there is provided a display including an address generator according to the first aspect of the invention.

The display may be of matrix type, for instance of active matrix type, and may be of liquid crystal type.

According to a fourth aspect of the invention, there is provided a display characterised by a display device, a tracking for determining an observed region of the display device at which an observer is looking, and an image data generator responsive to the tracker for generating image data with a first spatial resolution for the observed region and with a second spatial resolution less than the first resolution for another region of the display device.

The display device may comprise a display according to the third aspect of the invention.

It is thus possible to provide an arrangement which allows variable resolution to be achieved in a display or spatial light modulator. In regions of such a device where the full spatial resolution of the device is not required, the device may be operated at reduced resolution. This allows the addressing speed of the device to be increased while reducing the amount of data required to update each frame. The device itself does not require modification to achieve this. In particular, the address generator or generators supply signals which allow variable resolution to be achieved without modification of the basic device.

BRIEF DESCRIPTION OF THE DRAWINGS

The invention will be further described, by way of example, with reference to the accompanying drawings, in which.

DETAILED DESCRIPTION OF THE INVENTION

Figure 1:
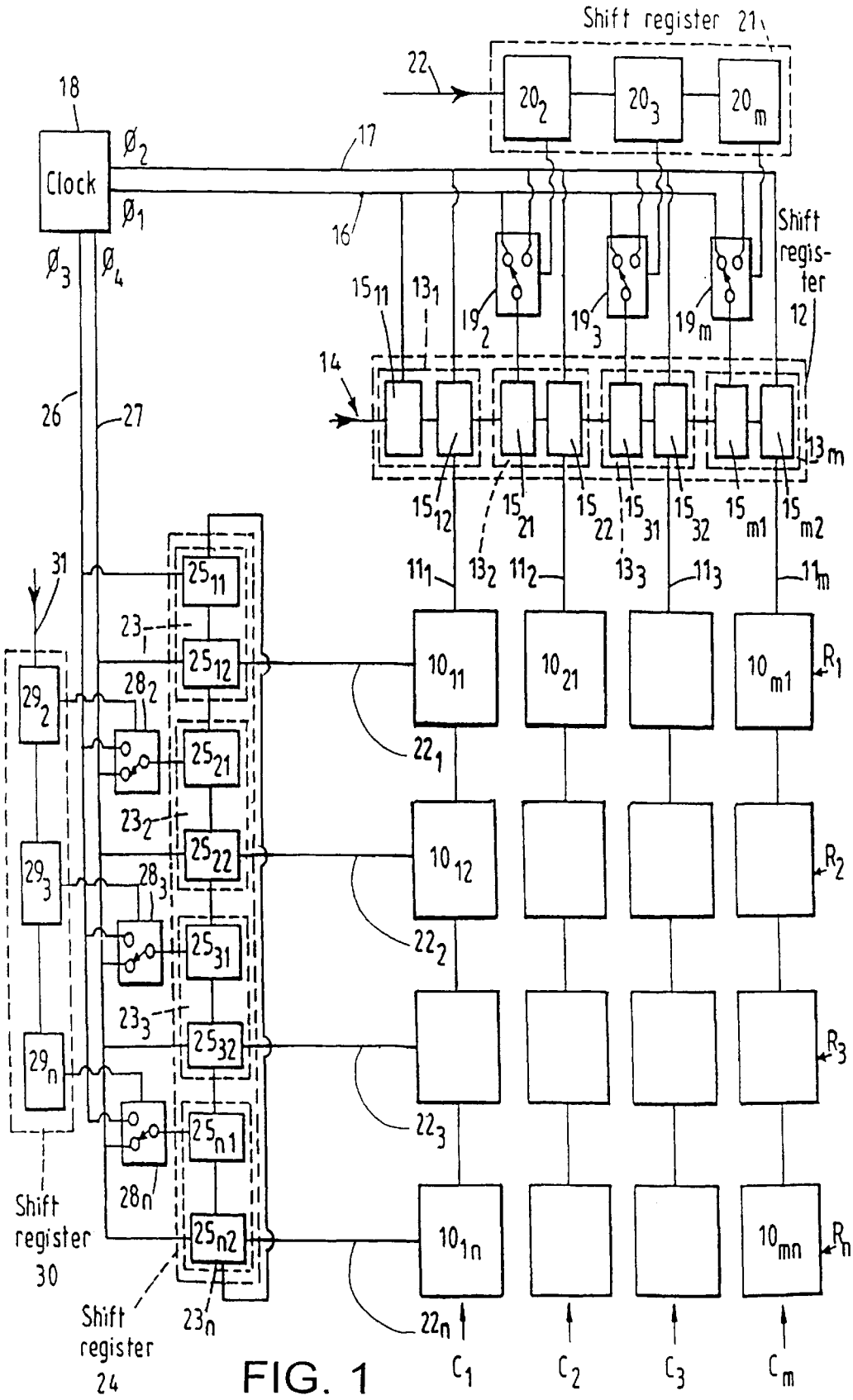
FIG. 1 is a block schematic diagram of a device constituting a preferred embodiment of the invention.

Like reference numerals refer to like parts throughout the drawings.

The device shown in FIG. 1 may be embodied as a spatial light modulator or as a display using any suitable addressing and optical or light emitting technology. However, for convenience of description, the device of FIG. 1 will be described as an active matrix liquid crystal display.

The display comprises n rows $R_1$ to $R_n$ and m columns $C_1$ to $C_m$ arranged as a rectangular matrix of picture elements (pixels) $\mathbf{10}_{11}$ to $\mathbf{10}_{mn}$, where the pixel of the ith column and the jth row is referred to as $\mathbf{10}_{ij}$. For clarity of illustration, only sixteen of the pixels $\mathbf{10}_{ij}$ are shown in FIG. 1.

The columns of the display are addressed by means of column electrodes $\mathbf{11}_1$ to $\mathbf{11}_m$ which are connected to a shift register 12. The shift register 12 comprises cascade-connected stages $\mathbf{13}_1$ to $\mathbf{13}_m$ to form a series-in/parallel-out shift register having a data input 14 for receiving serial display row data. Each of the shift register stages $\mathbf{13}_1$ to $\mathbf{13}_m$ comprises first and second memory devices $\mathbf{15}_{11}$, $\mathbf{15}_{12}$, to $\mathbf{15}_{m1}$, $\mathbf{15}_{m2}$. Each of the second memory devices $\mathbf{15}_{12}$ to $\mathbf{15}_{m2}$ has an output connected to the respective column addressing line $\mathbf{11}_1$ to $\mathbf{11}_m$ and to the input of the first memory device of the succeeding shift register stage. The second memory devices $\mathbf{15}_{12}$ to $\mathbf{15}_{m2}$ have lock inputs connected to a second line 17 of a bi-phase clock line which receives clock signals $\phi_2$ from a clock 18. The first memory device $\mathbf{15}_{11}$ of the first stage $\mathbf{13}_1$ has a clock input connected to a first line 16 of the bi-phase clock line and receives clock signals $\phi_1$ from the clock 18.

The first memory devices $\mathbf{15}_{21}$ to $\mathbf{15}_{m1}$ of the remaining stages $\mathbf{13}_2$ to $\mathbf{13}_m$ of the shift register 12 are connected to respective switching elements $\mathbf{19}_2$ to $\mathbf{19}_m$, each of which has first and second inputs connected to the lines 16 and 17, respectively. The switching elements $\mathbf{19}_2$ to $\mathbf{19}_m$ have switch control inputs connected to the outputs of respective stages $\mathbf{20}_2$ to $\mathbf{20}_m$ of a shift register 21 of the serial-in/parallel-out type. The shift register 21 has an input 22 for receiving configuration data in serial form for determining which of the first and second inputs of each switching element $\mathbf{19}_2$ to $\mathbf{19}_m$ is connected to its output. Suitable arrangements (not shown) are providing for clocking the configuration data into the shift register 21.

The display further comprises row addressing electrodes $\mathbf{22}_1$ to $\mathbf{22}_n$ which are connected to the outputs of respective stages $\mathbf{23}_1$ to $\mathbf{23}_n$ of a shift register 24. The stages of the shift register 24 comprise first and second memory devices $\mathbf{25}_{11}$, $\mathbf{25}_{12}$ to $\mathbf{25}_{n1}$, $\mathbf{25}_{n2}$. The shift register 24 is of the same type as the shift register 12 and differs therefrom only in that the input of the first memory device $\mathbf{25}_{11}$ is connected to the output of the last memory device $\mathbf{25}_{n2}$ so that the shift register 24 operates as a "ring register" continually recirculating the binary data therein. Means (not shown) are provided for presetting the shift register 24 when power is applied to the display such that the memory device $\mathbf{25}_{12}$ is set to "1" whereas all of the other memory devices are reset to "zero". The shift register 24 thus supplies a strobe pulse sequentially to the row electrodes $\mathbf{22}_1$ to $\mathbf{22}_n$ for controlling writing of display data into the pixels $\mathbf{10}_{ij}$ of the display.

The clock 18 supplies clock pulses $\phi_3$ and $\phi_4$ to lines 26 and 27, respectively, of another bi-phase clock line. The device further comprises switching elements $\mathbf{28}_2$ to $\mathbf{28}_n$ and stages $\mathbf{29}_2$ to $\mathbf{29}_n$ of a shift register 30 having a configuration data input 31, all of which are identical to the switching elements $\mathbf{19}_2$ to $\mathbf{19}_m$ and the shift register 21 and will not therefore be described further.

Figure 2:
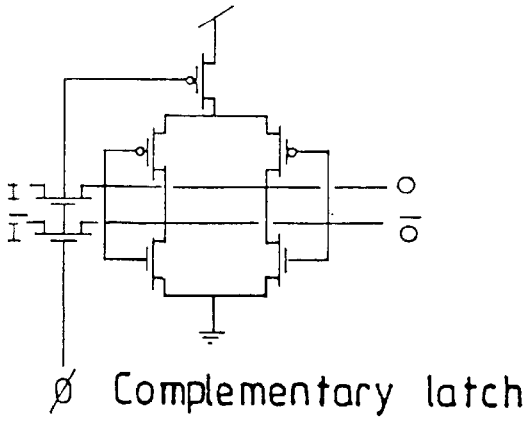
FIGS. 2 and 3 are circuit diagrams of elements of the device of FIG. 1.

Each of the memory devices $\mathbf{15}_{11}$ to $\mathbf{15}_{m2}$ and $\mathbf{25}_{11}$ to $\mathbf{25}_{n2}$ may be embodied as a complimentary latch of the type illustrated in FIG. 2. The latch comprises a plurality of complimentary metal oxide on silicon field effect transistors arranged to function as a bi-stable element or flip-flop having normal and inverted inputs I, $\overline{I}$, normal and inverted outputs O, $\overline{O}$, and a clock input $\phi$.

Figure 3:
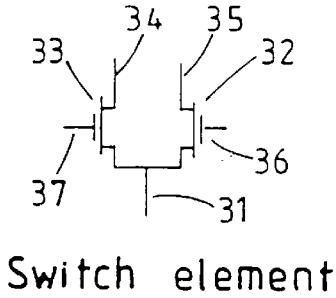

The switching elements $\mathbf{19}_2$ to $\mathbf{19}_m$ and $\mathbf{28}_2$ to $\mathbf{28}_n$ may each be embodied as shown in FIG. 3. The switching element comprises an input 31 connected to the sources of metal oxide on silicon field effect transistors 32 and 33, first and second outputs 34 and 35 connected to the drains of the transistors 33 and 32, respectively, and complementary control inputs 36 and 37 connected to the gates of the transistors 32 and 33, respectively. The arrangements shown in FIGS. 2 and 3 are of known type and will not be described further.

Figure 4:
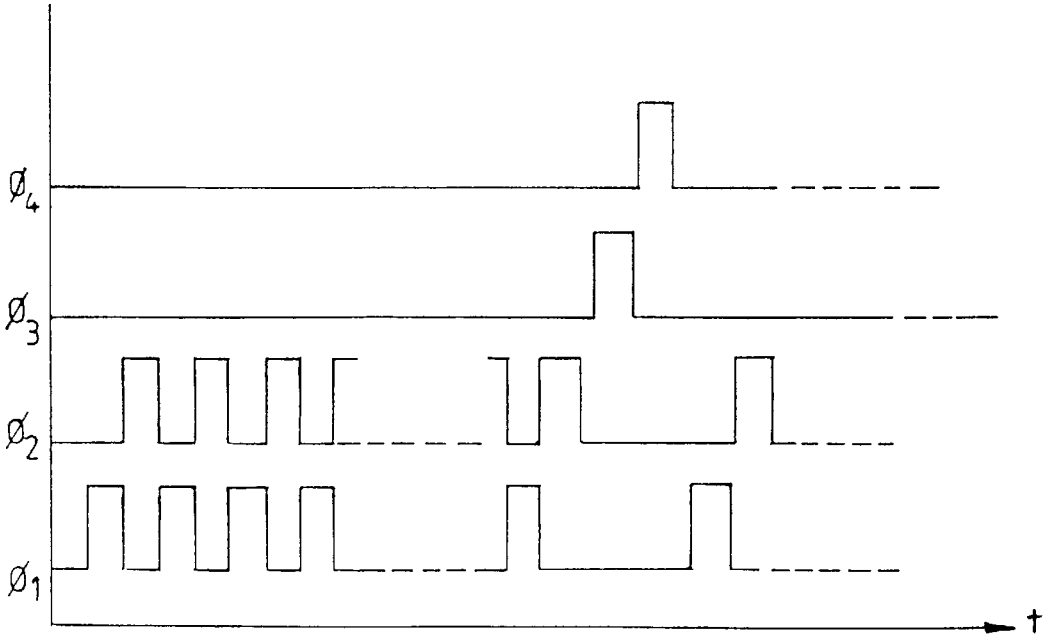
FIG. 4 is a diagram illustrating waveforms occurring in the device of FIG. 1.

FIG. 4 is a timing diagram illustrating the two sets of bi-phase clock pulses $\phi_1$, $\phi_2$ and $\phi_3$, $\phi_4$. The clock pulses $\phi 1$ and $\phi 2$ are supplied to the lines 16 and 17 by the clock 18 in synchronism with serial display data supplied to the input 14 of the shift register 12. When a complete row of fresh display data has been written into the shift register 12, the clock pulses $\phi_1$ and $\phi_2$ are suspended and the bi-phase clock pulses $\phi_3$ and $\phi_4$ are supplied to the lines 26 and 27 by the clock 18 so that the shift register 24 supplies a strobe pulse to the next row or rows of pixels $\mathbf{10}_{ij}$. The row of display data is written into the corresponding row of pixels and is displayed until that row is again refreshed. The bi-phase clock pulses $\phi_1$ and $\phi_2$ are then supplied to the lines 16 and 17 so as to enter the next row of display data into the shift register 12, This process is repeated continuously so that the display is continuously refreshed on a row-by-row basis. When the last row $R_n$ has been refreshed, the process is repeated starting at the first row $R_1$.

Figure 5:
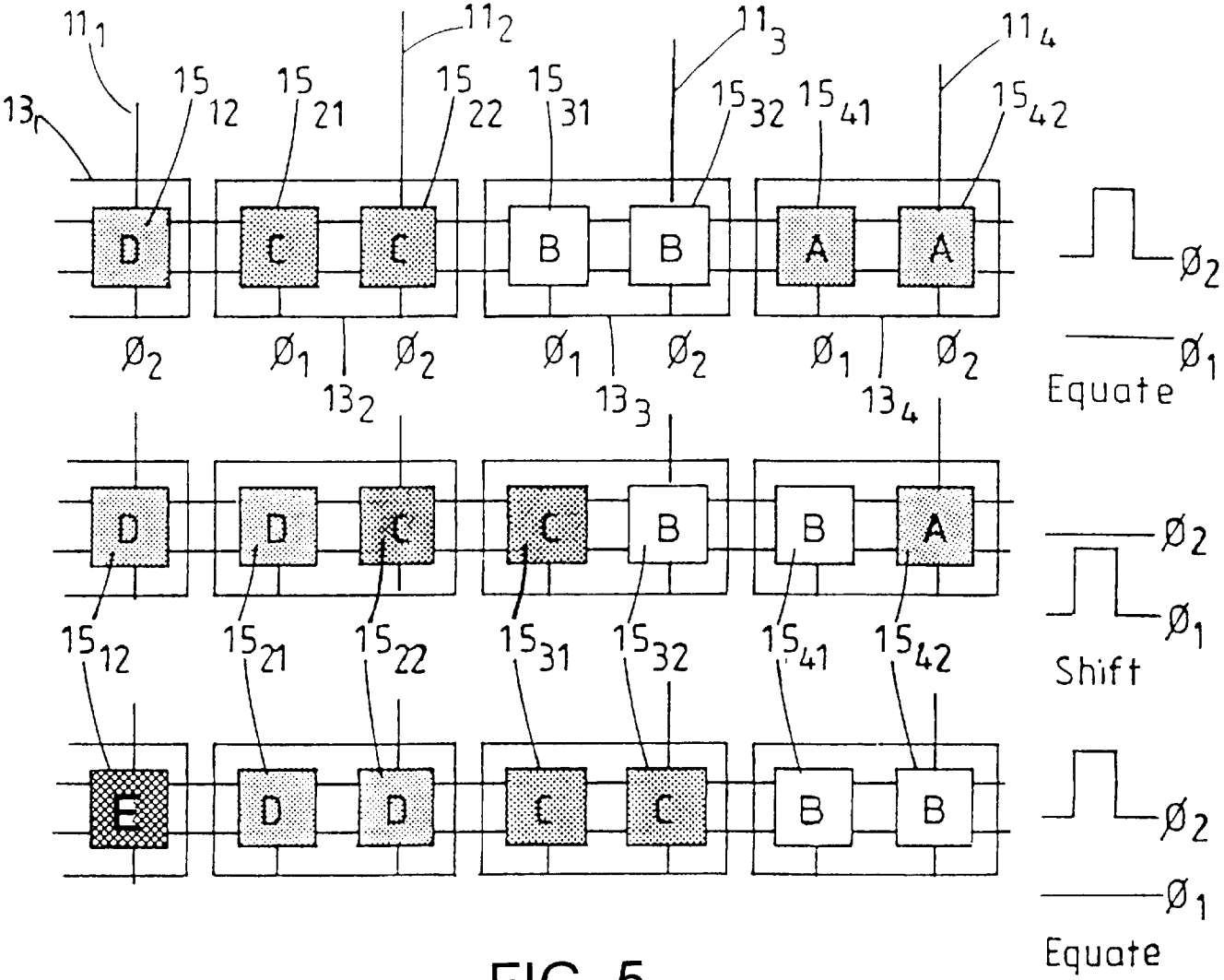
FIGS. 5 and 6 are schematic diagrams illustrating operation of shift registers of the device of FIG. 1.

FIG. 5 illustrates operation of the display using the full spatial resolution of the display. Operation of the shift register 12 is illustrated, the operation of the shift register 24 being substantially identical. The binary display data are represented by the letters A, B, C, D, E. The switching elements $\mathbf{19}_2$ to $\mathbf{19}_4$ are controlled by the shift register 21 such that the clock inputs of the memory devices $\mathbf{15}_{21}$ to $\mathbf{15}_{41}$ are connected to the line 16 so as to receive the first phase clock pulses $\phi_1$.

The upper row of FIG. 5 illustrates the application of a clock pulse $\phi_2$ which causes the data contained in the memory devices $\mathbf{15}_{22}$ to $\mathbf{15}_{42}$ to be equated to the data contained in the memory devices $\mathbf{15}_{21}$ to $\mathbf{15}_{41}$, respectively. The middle row in FIG. 5 illustrates the application of a clock pulse $\phi_1$ to the first memory devices $\mathbf{15}_{21}$ to $\mathbf{15}_{41}$ to perform a shift operation. This causes the data in each of the second memory devices to be written into the first memory device of the succeeding stage of the shift register. Thus, the bit D contained in the second memory device $\mathbf{15}_{12}$ of the stage $\mathbf{13}_1$ is written into the memory device $\mathbf{15}_{21}$ of the stage $\mathbf{13}_2$, and so on.

The bottom row of FIG. 5 illustrates the application of the next clock pulse $\phi_2$ to perform the equate function. The bit in the first memory device of each stage of the shift register is clocked into the second. memory device so as to complete one cycle of operation of the shift register 12. Thus, each stage $\mathbf{13}_1$ to $\mathbf{13}_m$ of the shift register 12 contains a bit for individually controlling the corresponding pixel of the row of the display which is to be refreshed.

Figure 6:
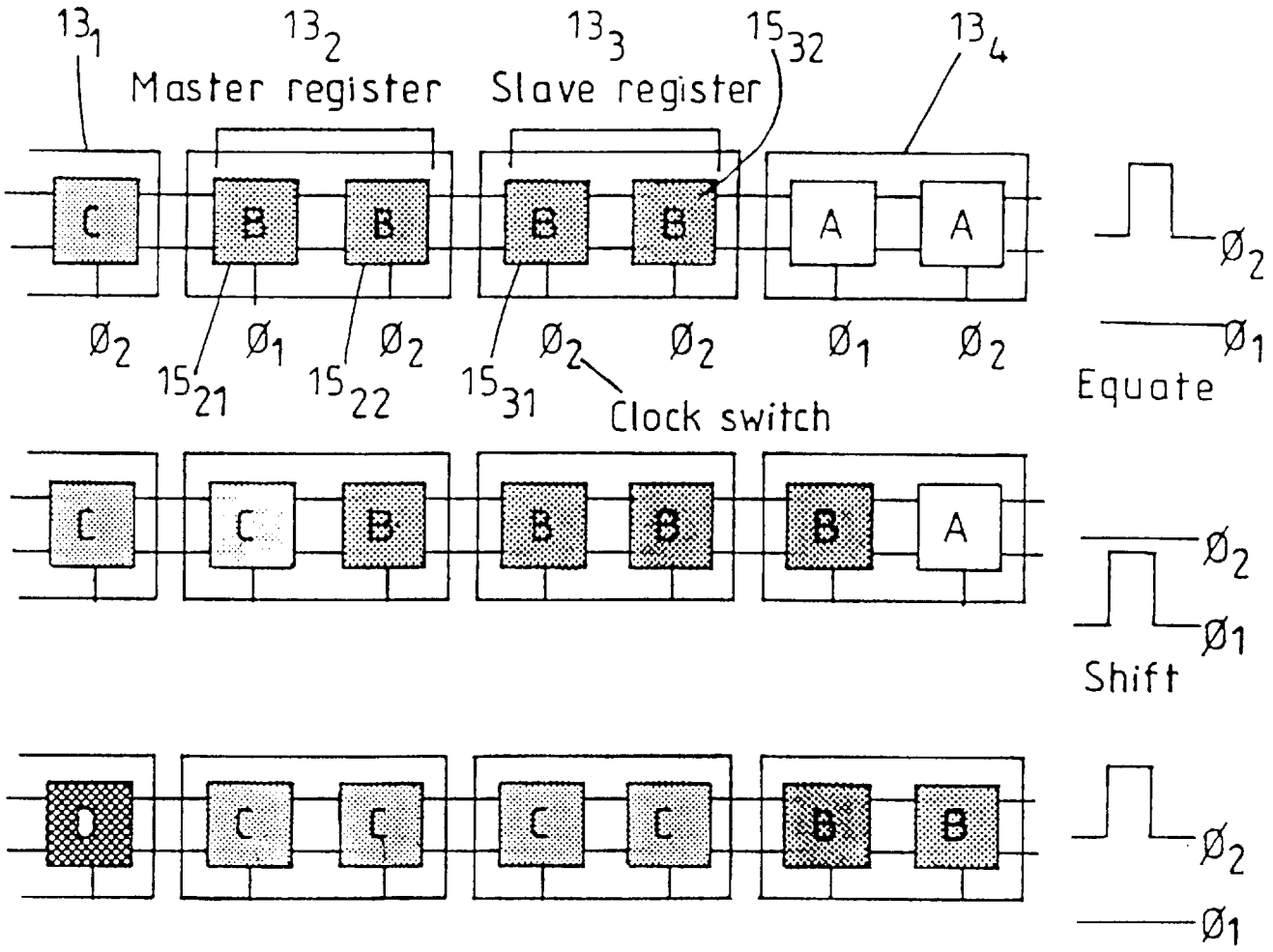

FIG. 6 is similar to FIG. 5 but illustrates operation when reduced horizontal spatial resolution is required. The configuration data in the shift register 21 are such that the switching element $\mathbf{19}_3$ connects.the clock input of the memory device $\mathbf{15}_{31}$ to the line 17 so as to receive the clock pulses $\phi_2$. The stage $\mathbf{13}_3$ thus functions as a slave register whereas other stages, such as the stage $\mathbf{13}_2$, functions as illustrated in FIG. 5 as a master register.

The operation of the stage $\mathbf{13}_3$ differs in that it does not perform a shift function. Instead, whenever a clock pulse $\phi_2$ is supplied to perform the equate operation, both memory devices $\mathbf{15}_{31}$ and $\mathbf{15}_{32}$ of the stage $\mathbf{13}_3$ store the bit at the output of the second memory device $\mathbf{15}_{22}$ of the preceding stage $\mathbf{13}_2$. Thus, apart from propagation and parasitic delays through the memory devices $\mathbf{15}_{31}$ and $\mathbf{15}_{32}$, the address lines $\mathbf{11}_2$ and $\mathbf{11}_3$ receive simultaneously the same address data for the row of the display to be refreshed. The pixels $\mathbf{10}_{2I}$ and $\mathbf{10}_{3j}$ of the jth row being refreshed are thus addressed effectively as a single pixel of greater horizontal size and therefore of reduced horizontal resolution.

The number of bi-phase clock pulses $\phi_1$, $\phi_2$ required to refresh a display row is equal to the number of the stages of the shift register 12 acting as master registers. Accordingly, when operation with reduced horizontal resolution is required, the time needed to refresh each row is. reduced so that the refresh rate of the display may be increased. Further, the reduced horizontal resolution requires a smaller amount of pixel display data to be calculated, for instance resulting in a reduced burden on a data processor controlling the display.

The shift register 24 may be operated in the same way when reduced vertical resolution is required. In this case, each slave register repeats the bit stored in the preceding master register so that a row of display data is written substantially simultaneously to two of the rows of the display. The time required to refresh a frame of display data is proportional to the number of the stages of the shift register 24 acting as master registers so that operation to provide reduced vertical resolution increases the frame refresh rate of the display. Also, as mentioned hereinbefore, the reduced resolution may result in a reduced burden of calculating display data by a data processor controlling the display.

It is thus possible to operate a display such that different regions have different effective spatial resolutions. The pixels may effectively be partitioned into "rectangular" groups which receive the same display data and which are addressed as though they were single pixels of lower resolution. This is achieved without requiring any changes in conventional active matrix pixel addressing circuitry since the resolution is defined by the operation of the address generator circuitry.

Figure 7:
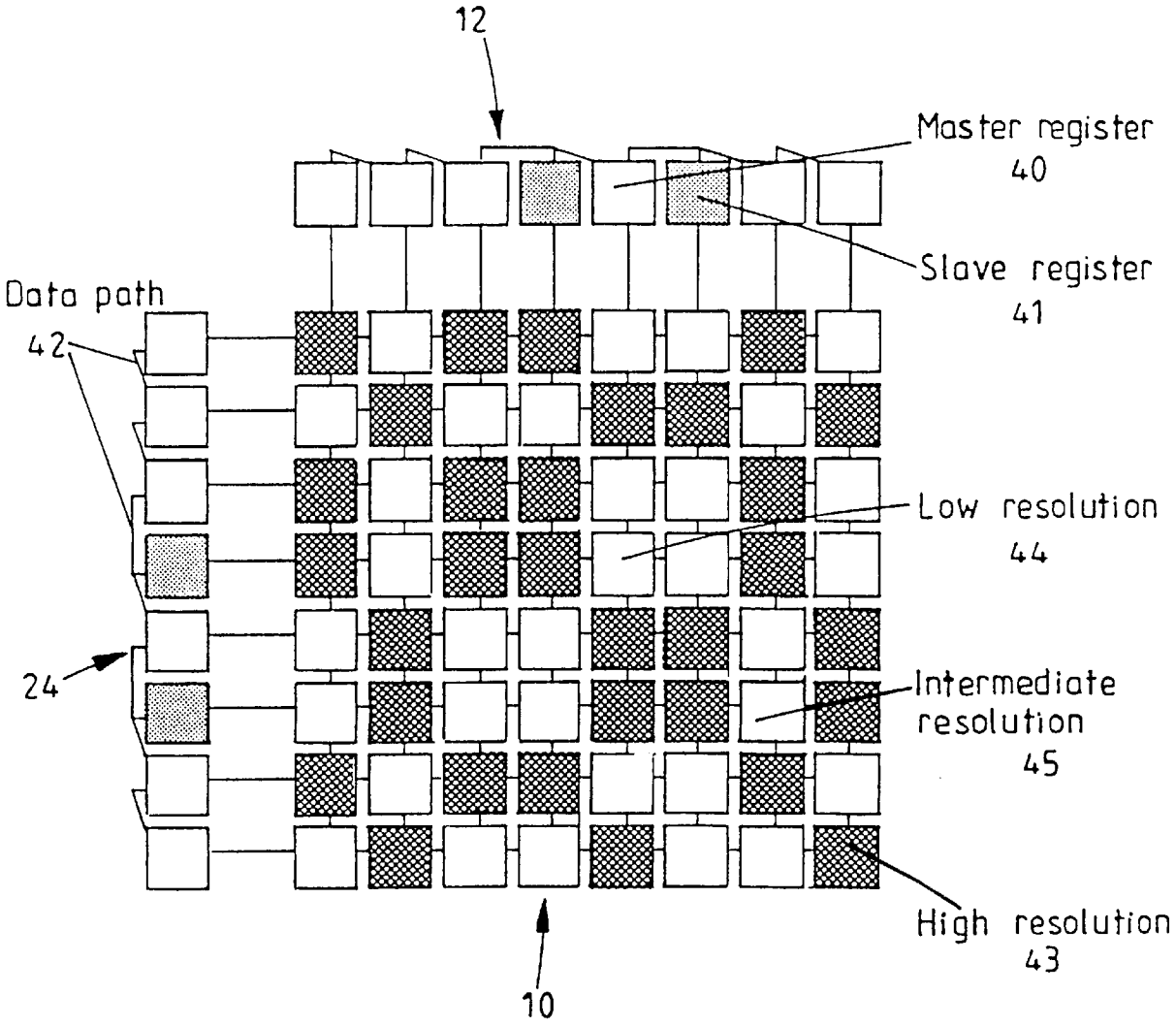
FIG. 7 is a schematic diagram illustrating variable resolution operation of the device of FIG. 1.

FIG. 7 illustrates operation of the display to provide regions of different resolution. The stages of the shift registers 12 and 24 are shown schematically as empty'squares representing stages acting as master registers, for instance as shown at 40, and shaded squares acting a slave registers, for instance as shown at 41. The pixels 10 are represented as empty squares corresponding to bright pixels and shaded squares corresponding to dark pixels. The data paths, for instance as shown at 42, indicate the propagation of data through the shift registers for each bi-phase clock pulse. Thus, data from a master register preceding a slave register is clocked substantially simultaneously into the slave register and into the succeeding master register. Although not shown, several consecutive stages may be operated as slave registers so that data from the preceding master register is clocked into all of the slave registers and into the succeeding master register substantially simultaneously.

Pixels displaying an image at high,resolution, corresponding to the full spatial resolution of the individual pixels, are illustrated at 43 and are located in regions addressed only by master registers in the shift registers 12 and 24. Low resolution regions, such as 44, are provided by pixels which are addressed by a master and one or more subsequent slave registers of both the shift register 12 and the shift register 24. In the region indicated at 44, a master register in each of the shift registers 12 and 24 is followed by a single slave register so that the effective pixel has half the resolution of the actual display pixels in both the vertical and horizontal directions.

An intermediate resolution region is illustrated at 45. The pixels of this region are addressed by master registers of the shift register 12 and by a master and at least one slave registers of the shift register 24. Thus, the horizontal resolution is equal to the horizontal resolution of the display pixels but the vertical resolution is equal to half the vertical resolution of the display pixels.

During reduced resolution operation, the pixels are addressed by contiguous columns and/or rows so as to form the rectangular groups effectively operating as single pixels. Reduced resolution operation is controlled by the patterns of binary data in the shift registers 21 and 30. The display resolution may therefore be reconfigured by changing the data held in the shift registers 21 and 30. This is achieved by serially entering fresh configuration data. The shift register 21 requires (m−1) bits of data to reconfigure the horizontal resolution whereas the shift register 30 requires (n−1) bits to reconfigure the vertical resolution.

In the case where high resolution is needed in certain specific areas (e.g. near the cursor on a computer screen) but not for the majority of the display, a very large display can be run at video rates using the proposed addressing scheme. This is because accessing the high resolution within any part of the display means that the size of the pixels must be small, which in turn necessitates a very large number of pixels in the device. To operate the display conventionally would require $N\{M\tau_1+\tau_2\}$ time steps per frame for a display having N×M pixels (N rows, M columns), a column update time of $\tau_1$ and a row update time of $\tau_2$. If only a fraction x of the pixel rows and y of the pixel columns are required at the highest resolution and the rest at an average of 1/z the resolution, a frame time of only $(P\tau_1+\tau_2)Q+\tau_3$ is required, where $P=Mx+M(1-x)/z, Q=Ny+N(1-y)/z$ and $\tau_3$ is the reconfiguration time which would be approximately $(M+N)\tau_1$. These expressions are valid when z is not too large to increase the effective values of $\tau_1$ or $\tau_2$. For most practical purposes P<N and Q<M. As an example, for z=10 and y=x=0.1, a frame period $0.19N\{0.19M\tau_1+\tau_2\}+(M+N)\tau_1$ is required, which for M~N~500 could either increase the frame rate by ~5 or by ~25 depending on the relative sizes $\tau_1$ of $\tau_2$ (dependent on panel size). This would allow very large displays to be operated at video rates, whereas using conventional addressing would mean an unusable 2 Hz frame update for a similar performance display.

Savings in addressing time and computation can also be made if only part of a frame is written with a certain column register configuration, and with the remaining parts written with alternative configurations. For example, if a frame can be split into l sets of rows each having a column configuration which effectively reduces the line update time to $P\tau_1+\tau_2$, and an effective number of rows per part =Q/l, then the frame time is given by $(P\tau_1+\tau_2)Q+l(M+N)\tau_1$. For small values of l, this represents a time saving comparable with the case above but with the advantage of varying column resolution as a function of the frame row.

In other applications of this addressing scheme, row data may be used instead of the strobing of pixel rows described hereinbefore by a "recirculating" strobe pulse. The arrangement shown in FIG. 1 may be modified to achieve this by disconnecting the input of the stage $\mathbf{23}_1$ from the output of the stage $\mathbf{23}_n$ and connecting it to a data input for receiving serial column data. The row and column data may then be read into the shift registers 12 and 24, respectively, and the whole SLM "strobed" to read the data into the pixels $\mathbf{10}_{ij}$ simultaneously. Such an arrangement is useful where two dimensionally repeated patterns, such as holographic gratings are to be "displayed" by a SLM.

For many computer generated images, each pixel has to be computed separately. This can take a very large amount of time, so typically where coarse resolution produces an adequate image, only a sparse number of pixels are computed to save time. It is known that, to match the coarse resolution of the computed image to that of the display, pixel values may be filled in either by interpolation techniques or simply by replication. This filling in and subsequent need for a very high specification display driver device would be unnecessary with the addressing scheme proposed. Since the proposed effective encoding of the display/SLM device is compatible with sparse computation of pixel points, a low specification display driver can be used, thus reducing hardware cost and physical size. The reduction in computation rate would also result in an energy saving as the energy consumption of microprocessors is roughly proportional to clock rate.

Figure 8:
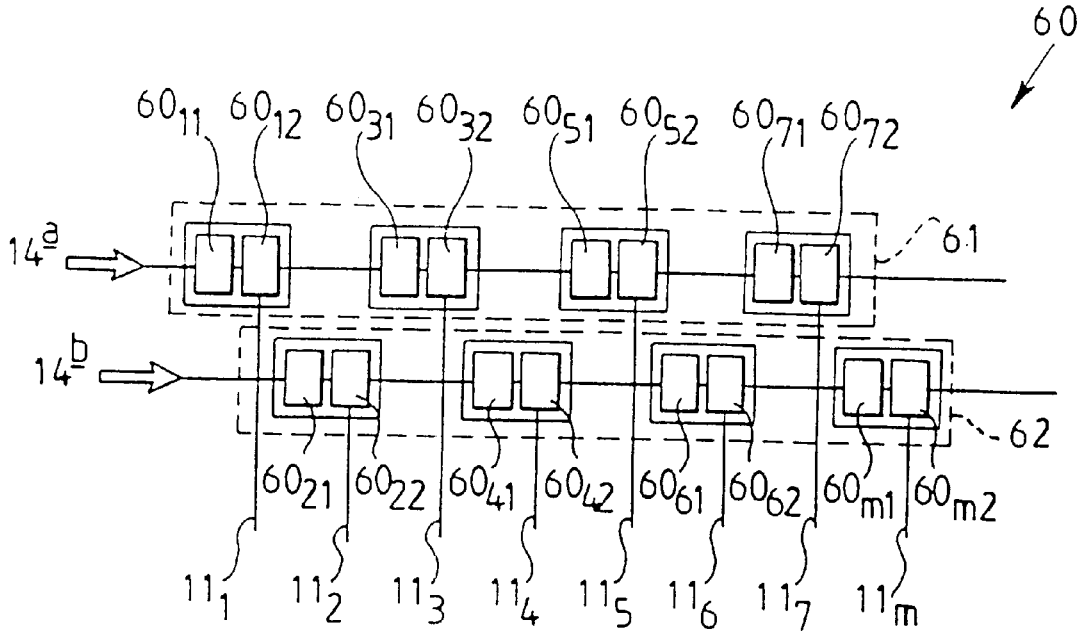
FIG. 8 is a schematic diagram illustrating another embodiment of the device of FIG. 1.

In another embodiment of the display device of FIG. 1, an interlaced architecture is provided (FIG. 8). Such an architecture can be used with any of the above described addressing schemes. Instead of a single shift register 12, an interlaced shift register 60 is provided. The interlaced shift register 60 comprises a first and a second sub-shift register 61, 62, the stages of the first sub-shift register 61 being interlaced with the stages of the second sub-shift register 62. The first and second sub-shift registers 61, 62 are each of the same type as the shift register 12.

The stages of the interlaced shift register 60 comprise first and second memory devices $\mathbf{60}_{11}$, $\mathbf{60}_{12}$ to $\mathbf{60}_{m1}$, $\mathbf{60}_{m2}$. Each of the second memory devices $\mathbf{60}_{12}$ to $\mathbf{60}_{m2}$ has an output connected to the respective column addressing line $\mathbf{11}_1$ to $\mathbf{11}_m$ and to the input of the first memory device $\mathbf{60}_{11}$ to $\mathbf{60}_{m1}$ of the succeeding shift register stage of the respective one of the sub-shift register 61, 62.

The data input 14 comprises a first sub-data input 14*a* and a second sub-data input 14*b*. Serial display row data is split and processed in order to produce first and second serial display row data for the first and second sub-data inputs 14*a*, 14*b*, respectively.

The second memory devices $\mathbf{60}_{12}$ to $\mathbf{60}_{m2}$ have clock inputs (not shown) connected to the second line 17 of the bi-phase clock line which receives clock signals $\phi_2$ from the clock 18. The first memory device $\mathbf{60}_{11}$ has a clock input (not shown) connected to the first line 16 of the bi-phase clock and receives clock signals $\phi_1$ from the clock 18. The first memory devices $\mathbf{60}_{21}$ to $\mathbf{60}_{m1}$ of the interlaced shift register 60 are connected (connections not shown) to the respective switching elements $\mathbf{19}_2$ to $\mathbf{19}_m$.

Figure 9:
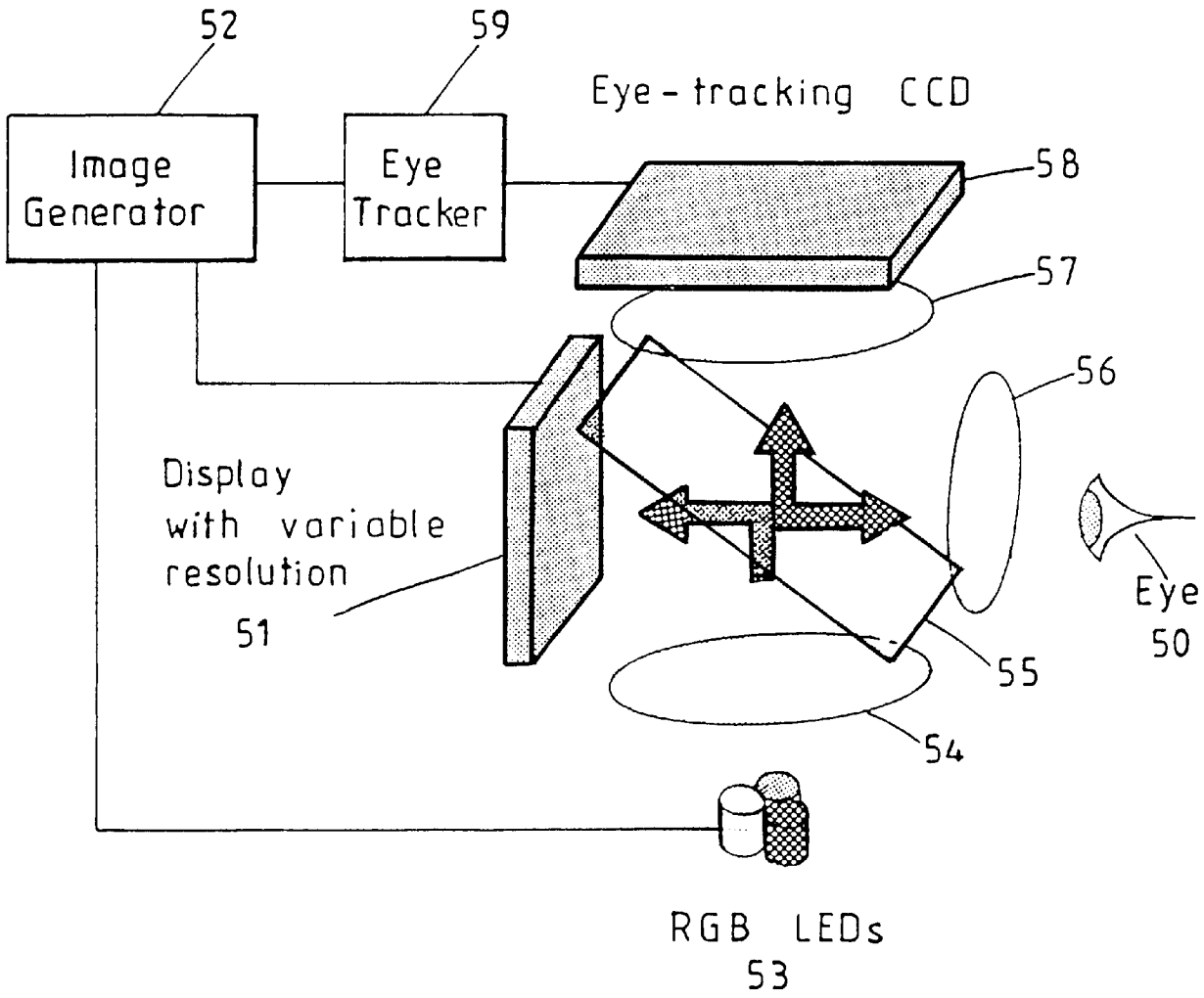
FIG. 9 illustrates schematically an application of the device shown in FIG. 1.

A display of the type shown in FIGS. 1 or 8 may be used to provide a virtual reality (VR) headset as illustrated in FIG. 9. Each eye 50 of the observer is provided with a reflective display 51 of the type shown in FIG. 1 capable of providing variable resolution. The display is controlled by an image generator 52 which also controls red, green, and blue light emitting diodes 53 which are operated sequentially so as to provide a colour display to each eye. Light from the light emitting diodes 53 is collimated by a lens 54 and reflected by a beam splitter, such as a partially silvered mirror, onto the display 51, which spatially modulates the incident light. The light modulated with the image to be displayed is reflected from the display 51 through the beam splitter 55 and a lens 56 so that the image can be viewed by the eye 50.

Light reflected from the eye 50 passes through the lens 56 and is reflected by the beam splitter 55 through a lens 57 to an eye-tracking charge coupled device (CCD) 58 so that an image of the eye 50 is formed on the CCD. The output of the CCD is supplied to an eye tracker 59 which analyses the image of the eye so as to recognise the pupil and the part of the display 51 at which the eye is looking. This information is passed to the image generator 52.

The image generator 52 controls the resolution of the display 51 so that the region at which the eye is looking i.e. the region imaged at and around the fovea of the eye, is operated at the full spatial resolution of the display whereas the remainder of the display is operated at reduced resolution. The red, green, and blue components of the colour image are supplied in sequence to the display 51 synchronously with operation of the RGB light emitting diodes 53.

The image generator 52 also generates the image data which are to be displayed by the display 51. For synthetically generated images, the image generator 52 effectively contains data concerning the positions of key points of the image to be displayed and software for performing predetermined rules for generating from those points the necessary image data. The image generator 52 thus calculates image data for all of the pixels in the region at which the eye is looking but generates sparse pixel image data corresponding to the reduced resolution for the remainder of the display.

It is thus possible to use a display 51 which, if operated at full resolution across the whole of the display, would not be capable of being refreshed sufficiently quickly to prevent disturbing visual artifacts, such as flicker, from being visible. Because it is only necessary to operate the display at its full resolution in the region at which the eye is looking with the remainder being operated at reduced resolution, a relatively slow display can be refreshed sufficiently quickly to avoid or substantially reduce such undesirable visual artifacts.

Similarly, the processing power required by the image generator 52 to generate the image data is substantially reduced because it is only necessary to calculate pixels to high spatial resolution in the region which is being viewed by the eye. Other regions can be adequately represented by a reduced spatial density of pixels so that the number of calculations required to refresh each frame of the display can be substantially reduced. It is thus possible for very high resolution displays to be updated at video rates while making substantial savings in computation time and hence in required computation power and electrical power consumption.

The display 51 of the type shown in FIG. 1 may be replaced by a conventional very high resolution display provided that such a display is capable of being refreshed at normal video rates to avoid the visibility of undesirable visual artifacts. However, where processing power in the image generator 52 is a limiting factor, then the image generator 52 operates in the same way to provide high resolution pixel data in the region of the display being viewed by the eye and reduced resolution image data for the remainder of the display. For instance, image data for a single pixel may be calculated at the middle of a group of pixels with that image data being duplicated in all of the display pixels. It is therefore possible to overcome processing limitations within the image generator 52 whether using a conventional very high resolution display or a variable resolution display of the type shown in FIG. 1.

It is further possible to reduce the data rate to the display 51 by not supplying colour information to the regions represented by reduced spatial density of pixels. For instance, the green image data may be used effectively as monochrome data and may be split in time between the updating of the 3 RGB subframes by updating every third course pixel with the low resolution green frame information per subframe.

In a possible alternative embodiment, the colour sequential display shown in FIG. 9 and comprising the display 51 and the light emitting diodes 53 could be replaced by a display in which fixed color filters are provided as RGB triplets so that all colour data are displayed for each frame. The "course resolution" regions automatically amalgamate colors and minimal information is lost because of the color blindness of the retinal cones in the human peripheral vision. The information of the green pixels would preferably be used to update the low resolution regions because this corresponds to the peak response of the receptors of the human eye.

It is possible to provide a virtual reality (VR) headset where eye tracking can be included to track where the eye is looking in order to write to the display in this viewing region at the highest resolution. The periphery can then be written at lower resolution. This is a saving for the display technology allowing very high resolution displays to be updated at video rates and is also compatible with savings in computation where the images need only be computed to high resolution in the region which the eye views.

As described above, the modified shift register update scheme can increase frame speeds for devices with very large pixel counts. Large pixel counts and update rates are required in the area of spatial light modulators for encoding coherent beams. This scheme is therefore particularly relevant for this area, especially since variable frame rates (a consequence of efficiently implementing the variable resolution scheme) are tolerated and simple alteration in resolution of a particular pattern can be of benefit (e.g. wavelength selection, angular beam scanning). Applications of coherent beam manipulation by SLMs include beam steering (e.g. laser printing), optical interconnections (e.g. fibre to fibre X-bar switches) and optical computing.

By configuring the shift registers such that those used to write pixels in areas not displaying information (dark bands) are grouped together, variable aspect displays are possible that do not require complex data manipulation of the image data. By grouping registers as described, only two extra lines and possibly two pixels per line need be added to the data to display the correct image. This would require small alterations in addressing speed to allow near synchronous operation with the incoming data, thus possibly overcoming the need for local data storage.

In all the above applications, a display or SLM using this scheme can be programmed in software to be a conventional display, capable of addressing independently all pixels. This is important when considering compatibility with conventional systems.

The techniques disclosed herein do not relate to any specific technologies and can be implemented, for instance, for any device where active matrix addressing is used and mixed resolution update can be used. As described hereinbefore, one possible use is in flat panel display technologies such as active matrix addressed liquid crystal displays. This established technology uses amorphous or polysilicon circuitry on glass substrates to address a 2D modulator array for displaying images. It would be possible to trade off selective area resolution against addressing speed, which in most circumstances allows large fast displays to be realised without significant reduction in picture quality. Alternative displays and coherent optical modulator array technologies include a combination of semiconductor drive circuitry in conjunction with solid state modulators (e.g. PLZT, Deformable mirror devices) or emitters such as in thin plasma and vacuum electrofluorescent displays.

What is claimed is:

1. An address generator for a display or spatial light modulator, comprising a first shift register having a plurality of cascade-connected stages for controlling respective first address electrodes of the display or spatial light modulator, wherein the stages of the first shift register include a first reconfigurable shift register stage which is selectively operable in an alternate mode, in which the output of the first reconfigurable shift register stage follows the output of a preceding stage, and further wherein the first reconfigurable shift register stage and the preceding stage control adjacent first electrodes and the output of the first reconfigurable shift register stage follows the output of the preceding stage in the alternate mode so as to display the same visual data in two or more adjacent first address electrodes.

2. An address generator as claimed in claim 1, wherein the first shift register is an analog shift register.

3. An address generator as claimed in claim 1, wherein the first shift register is a digital shift register.

4. A spatial light modulator comprising an address generator as claimed in claim 1.

5. A spatial light modulator as claimed in claim 4, being of matrix type.

6. A spatial light modulator as claimed in claim 5, being of active matrix type.

7. A spatial light modulator as claimed in claims 4, being of liquid crystal type.

8. A display comprising an address generator as claimed in claim 1.

9. A display as claimed in claim 8, being of matrix type.

10. A display as claimed in claim 9, being of active matrix type.

11. A display as claimed in claim 8, being of liquid crystal type.

12. An address generator for a display or spatial light modulator, comprising a first shift register having a plurality of cascade-connected stages for controlling respective first address electrodes of the display or spatial light modulator, wherein the stages of the first shift register include a first reconfigurable shift register stage which is selectively operable in an alternate mode, in which the output of the first reconfigurable shift register stage follows the output of a preceding stage, further wherein each stage of the first shift register comprises:

a first memory having a first memory enable input connected to a first phase of a first bi-phase clock line, and a second memory having a second memory enable input connected to a second phase of the first bi-phase clock line, wherein the first memory enable input of the first reconfigurable shift register stage of the first shift register being selectively connectable to the second phase of the first bi-phase clock line.

13. An address generator as claimed in claim 12, wherein each of the first and second memories comprises a bi stable circuit.

14. An address generator as claimed in claim 12, wherein each of the stages subsequent to a first stage of the first shift register comprises a switch for selectively connecting the first memory enable input to the first or second phase of the first bi-phase clock line.

15. An address generator as claimed in claim 14, further comprising a first further shift register having a plurality of cascade-connected stages for controlling respective ones of the switches of the first shift register.

16. An address generator for a display or spatial light modulator, comprising a first shift register having a plurality of cascade-connected stages for controlling respective first address electrodes of the display or spatial light modulator, wherein the stages of the first shift register include a first reconfigurable shift register stage which is selectively operable in an alternate mode, in which the output of the first reconfigurable shift register stage follows the output of a preceding stage, further wherein the first shift register comprises:

a first sub-shift register having a first plurality of cascade-connected sub-stages, and a second sub-shift register having a second plurality of cascade-connected sub-stages, wherein the first plurality of sub-stages being interlaced with the second plurality of sub-stages.

17. An address generator for a display or spatial light modulator, comprising a first shift register having a plurality of cascade-connected stages for controlling respective first address electrodes of the display or spatial light modulator, wherein the stages of the first shift register include a first reconfigurable shift register stage which is selectively operable in an alternate mode, in which the output of the first reconfigurable shift register stage follows the output of a preceding stage, further comprising a second shift register having a plurality of cascade-connected stages for controlling respective second address electrodes of the display or spatial light modulator, the stages of the second shift register including a second reconfigurable shift register stage which is selectively operable in the alternate mode.

18. An address generator as claimed in claim 17, wherein the second shift register is an analog shift register.

19. An address generator as claimed in claim 17, wherein the second shift register is a digital shift register.

20. An address generator as claimed in claims 17, wherein each stage of the second shift register comprises;

a third memory having a third memory enable input connected to a first phase of a second bi-phase clock line, and a fourth memory having a fourth memory enable input connected to a second phase of the second bi-phase clock line, wherein the third memory enable input of the second reconfigurable shift register stage of the second shift register being selectively connectable to the second phase of the second bi-phase clock line.

21. An address generator as claimed in claim 20, wherein each of the third and fourth memories comprises a bistable circuit.

22. An address generator as claimed in claim 20, wherein each of the stages of the second shift register subsequent to a first stage thereof comprises a switch for selectively connecting the third memory enable input to the first or second phase of the second bi-phase clock line.

23. An address generator as claimed in claim 22, further comprising a second further shift register having a plurality of cascade-connected stages for controlling respective ones of the switches of the second shift register.

* * * * *